United States Patent [19]

Tanaka et al.

[11] Patent Number: 4,997,120

[45] Date of Patent: Mar. 5, 1991

[54] METHOD AND APPARATUS FOR CONTROLLING TENSION WITH A LOCK MECHANISM

[75] Inventors: Hiroaki Tanaka; Kiyohito Suzuki, both of Kanagawa, Japan

[73] Assignee: Fuji Photo Film Co., Ltd., Kanagawa, Japan

[21] Appl. No.: 416,751

[22] Filed: Oct. 3, 1989

[30] Foreign Application Priority Data

Oct. 4, 1988 [JP] Japan ..... 63-250337

[51] Int. Cl.[5] ..... B65H 25/04; B65H 23/18

[52] U.S. Cl. ..... 226/44; 226/25; 242/75.51

[58] Field of Search ..... 220/44, 24, 25, 42; 242/75.51, 75.52

[56] References Cited

U.S. PATENT DOCUMENTS

| | | | |
|---|---|---|---|
| 3,905,533 | 9/1975 | Corse | 226/44 |
| 4,359,178 | 11/1982 | Hagashi et al. | 226/44 X |
| 4,708,301 | 11/1987 | Kataoku | 226/44 X |
| 4,848,630 | 7/1989 | Niestrath et al. | 226/44 X |

*Primary Examiner*—Daniel P. Stodola
*Assistant Examiner*—Paul Bowen
*Attorney, Agent, or Firm*—Sughrue, Mion, Zinn, Macpeak & Seas

[57] ABSTRACT

The tension on a tape web is controlled with a lock mechanism in an apparatus wherein a first dancer device, a pair of engaging-disengaging rolls, a second dancer device, and a pair of nip rolls are located in this order from the upstream side to the downstream side in the direction along which the tape web moves. The speed at which the engaging-disengaging rolls rotate is adjusted on the basis of the vertical position of a dancer roll of the first dancer device, and the speed at which the nip rolls rotate is adjusted on the basis of the vertical position of a dancer roll of the second dancer device, whereby the tension on the tape web is adjusted. A method for controlling the tension with a lock mechanism comprises the steps of locking the position of the dancer roll of the first dancer device at a predetermined position when the engaging-disengaging rolls disengage from each other, and releasing the dancer roll of the first dancer device from its locked position when the engaging-disengaging rolls engage with each other.

4 Claims, 1 Drawing Sheet

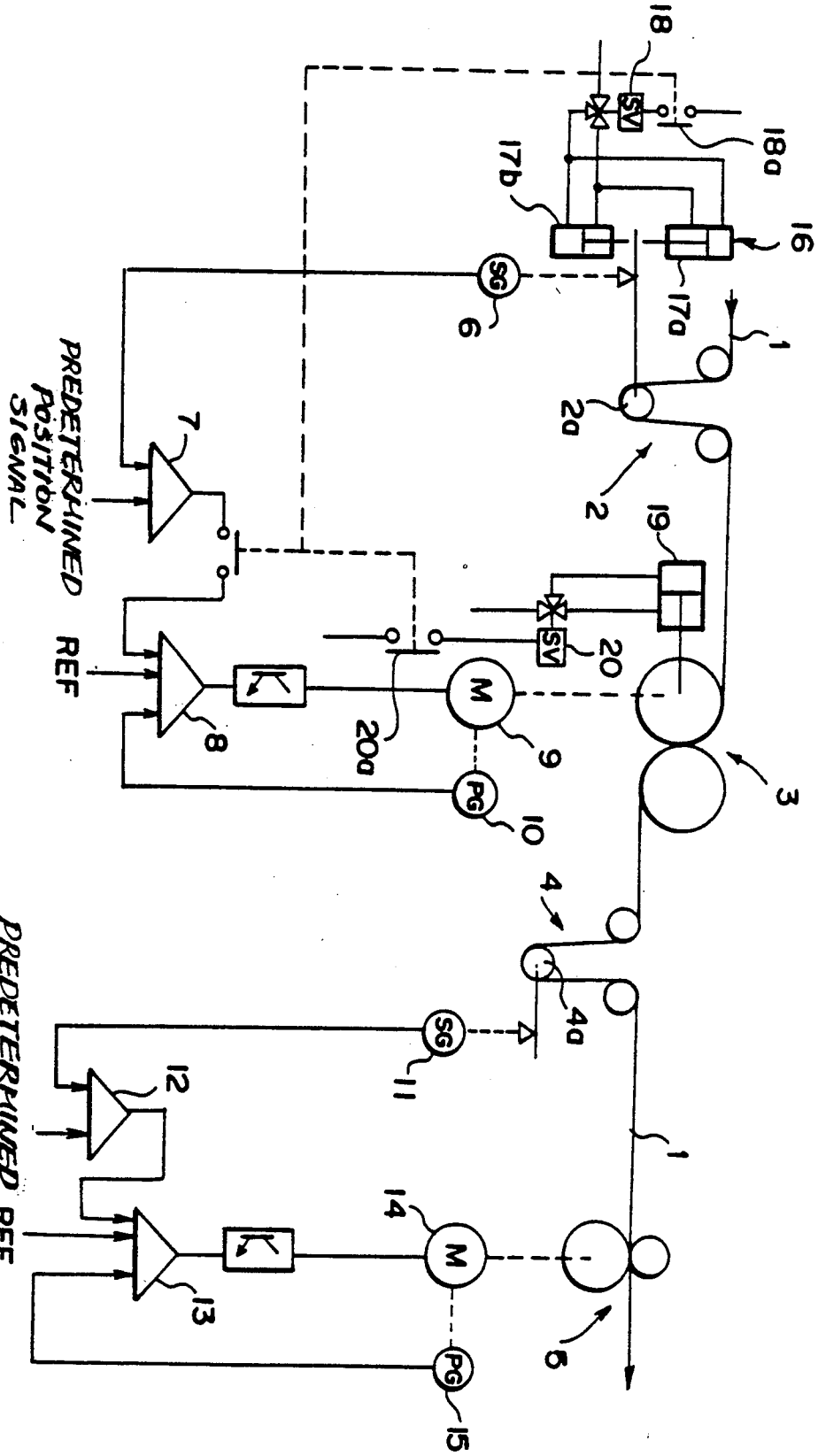
PREDETERMINED POSITION SIGNAL
REF
PREDETERMINED POSITION SIGNAL
REF
SV
SG
M
PG

METHOD AND APPARATUS FOR CONTROLLING TENSION WITH A LOCK MECHANISM

BACKGROUND OF THE INVENTION

1. Field of the Invention

This invention relates to a method for controlling the tension on a tape web, such as a magnetic tape web, in an apparatus wherein the long tape web is held by engaging-disengaging rolls and processed in various ways, while constant tension is applied to the long tape web. This invention particularly relates to a method for controlling tension with a lock mechanism, wherein the tension applied to a tape web is kept at a predetermined value even during the disengagement of the engaging-disengaging rolls from each other.

2. Description of the Prior Art

In the course of the manufacturing of tapes, such as magnetic tapes, tape webs are moved and various types of processing, such as coating, are carried out on the tape webs. In order to achieve processing uniformly over the overall area of the tape web, the tension applied to the long tape web is adjusted to a predetermined level in each section of an apparatus for manufacturing the tapes. For this purpose, by way of example, a dancer device is used wherein the tension on a tape web is kept at a predetermined value through the vertical movement of a dancer roll. Pairs of engaging-disengaging rolls are located in the tape web movement paths at various sections, such as a calendering section. The engaging-disengaging rolls engage with each other during the ordinary processing of the tape web, and disengage from each other when, for example, a tape web joint passes therebetween. The reason why the engaging-disengaging rolls disengage from each other, i.e. move away from each other, when a tape web joint passes therebetween is that if, for example, the tape web joint is pressed by the engaging-disengaging rolls, an adhesive which is applied at the tape web joint will flow out of the tape web joint or the tape web will be wrinkled However, when the engaging-disengaging rolls disengage from each other in a section of the apparatus in which the tapes are manufactured, the long tape web, which is moving, is released from the holding force of the engaging-disengaging rolls, and therefore the dancer roll of the dancer device moves down or up sharply. Such problems must be eliminated because a dancer device in the next section cannot quickly and accurately control the tension on the tape web.

In order to eliminate the aforesaid problems, subsidiary rolls have heretofore been located in the vicinity of the engaging-disengaging rolls in order to hold a tape web in lieu of the engaging-disengaging rolls while the engaging-disengaging rolls are disengaged from each other. In cases where such subsidiary rolls are provided, the position of the dancer roll does not change sharply even when the engaging-disengaging rolls disengage from each other.

However, in cases where the subsidiary rolls are provided, the apparatus for manufacturing the long tapes becomes large in size and complicated in configuration, and manufacturing the tapes becomes costly.

SUMMARY OF THE INVENTION

The primary object of the present invention is to provide a method for controlling tension with a lock mechanism, wherein the tension on a tape web is controlled reliably and accurately, even when engaging-disengaging rolls are disengaged from each other, without subsidiary rolls being used.

Another object of the present invention is to provide a method for controlling tension with a lock mechanism, which enables a tape manufacturing apparatus to be kept small in size and simple in configuration and which enables the cost of manufacturing the tapes to be kept low.

The method for controlling tension with a lock mechanism in accordance with the present invention is utilized in an apparatus, wherein a first dancer means, a pair of engaging-disengaging rolls, a second dancer means, and a pair of nip rolls are located in this order from the upstream side to the downstream side in the direction along which a tape web moves. In the method for controlling tension with a lock mechanism in accordance with the present invention, when the engaging-disengaging rolls are engaged with each other and a dancer roll of the first dancer means moves vertically in order to adjust the tension on a tape web, the engaging-disengaging rolls rotate in order to adjust the speed at which the tape web moves on the basis of the position of the dancer roll, so that the dancer roll returns to a predetermined position When a dancer roll of the second dancer means moves vertically in order to adjust the tension on the tape web, the nip rolls rotate in order to adjust the speed at which the tape web moves on the basis of the position of the dancer roll, so that the dancer roll returns to a predetermined position. The tension on the tape web is controlled in this manner. Also, as the engaging-disengaging rolls disengage from each other, the dancer roll of the first dancer means is locked simultaneously, and tension on the tape web is controlled by the second dancer means and the nip rolls.

Accordingly, the present invention provides a method for controlling tension with a lock mechanism, wherein a first dancer means, a pair of engaging-disengaging rolls, a second dancer means, and a pair of nip rolls are located in this order from the upstream side to the downstream side in the direction along which a tape web moves, the speed at which the engaging-disengaging rolls rotate is adjusted on the basis of the vertical position of a dancer roll of the first dancer means, and the speed at which the nip rolls rotate is adjusted on the basis of the vertical position of a dancer roll of the second dancer means, whereby the tension on the long tape web is adjusted, wherein the improvement comprises the steps of:

(i) locking the position of said dancer roll of said first dancer means at a predetermined position as said engaging-disengaging rolls disengage from each other, and (ii) releasing of said dancer roll of said first dancer means from the locked position when said engaging-disengaging rolls engage with each other.

With the method for controlling tension with a lock mechanism in accordance with the present invention, as the engaging-disengaging rolls disengage from each other, the position of the dancer roll of the first dancer means is locked. Therefore, when the engaging-disengaging rolls release the holding force on the tape web, the dancer roll of the first dancer means does not move sharply down or up. Accordingly, no problems arise with the configuration of the tape manufacturing apparatus. Slack in the tape web generated when engaging-disengaging rolls disengage from each other is taken up by movement of the dancer roll of the second dancer means. Also, the speed at which the nip rolls rotate increases in order to return the dancer roll of the second dancer means quickly to a predetermined position. Therefore, no problem arises with the control of the tension on the tape web.

As described above, when engaging-disengaging rolls are disengaged from each other, the tension on the tape web can be controlled reliably and accurately without subsidiary rolls being used. Therefore, with the method for controlling tension with a lock mechanism in accordance with the present invention, the tape manufacturing apparatus can be kept small in size and simple in configuration, and the cost of manufacturing the tapes can be kept low.

BRIEF DESCRIPTION OF THE DRAWING

The single drawing is a schematic view showing an example of a sectional drive apparatus wherein an embodiment of the method for controlling tension with a lock mechanism in accordance with the present invention is employed.

DESCRIPTION OF THE PREFERRED EMBODIMENTS

The present invention will hereinbelow be described in further detail with reference to the accompanying drawing.

A sectional drive apparatus is shown in the drawing and comprises a first dancer means 2, a pair of engaging-disengaging rolls 3, a second dancer means 4, and a pair of nip rolls 5, which are located in this order from the upstream side to the downstream side in the direction along which a magnetic tape web 1 moves A first section is constituted of the first dancer means 2 and the engaging-disengaging rolls 3. A second section is constituted of the second dancer means 4 and the nip rolls 5. In the first section, the tension on the magnetic tape web 1 is adjusted to a predetermined value by a dancer roll 2*a* of the first dancer means 2, which dancer roll moves vertically. The speed at which the engaging-disengaging rolls 3 rotate is controlled on the basis of the vertical position of the dancer roll 2*a*, so that the dancer roll 2*a* returns to a predetermined center position. In the second section, the tension on the magnetic tape web 1 is adjusted to a predetermined value by a dancer roll 4*a* of the second dancer means 4, which dancer roll moves vertically. The speed at which the nip rolls 5 rotate is controlled on the basis of the vertical position of the dancer roll 4*a*, so that the dancer roll 4*a* returns to a predetermined center position The engaging-disengaging rolls 3 grasp and move the magnetic tape web 1 in order to calender it. In their ordinary condition, the engaging-disengaging rolls 3 are engaged with each other, i.e. are positioned in contact with each other, in order to grasp the magnetic tape web 1 therebetween. In cases where, for example, a joint in the magnetic tape web 1 comes into the vicinity of the engaging-disengaging rolls 3, the engaging-disengaging rolls 3 disengage from each other, i.e. move away from each other, thereby releasing the magnetic tape web 1 so that the joint is not grasped How the tension on the magnetic tape web 1 is controlled when the engaging-disengaging rolls 3 are engaged with each other will be described hereinbelow. In the first section, the tension on the magnetic tape web 1 is controlled by the dancer roll 2*a* of the first dancer means 2, which dancer roll moves vertically. A position detector 6 detects the vertical position of the dancer roll 2*a* and generates a detection signal. The detection signal is fed to a comparator 7 which compares it with a predetermined position signal and generates a comparison signal, which represents the results of the comparison. The comparison signal and a predetermined reference signal are fed to an operation device 8. The operation device 8 also receives a detection signal, which is generated by a detector 10, on the basis of the number of revolutions of a motor 9 which rotates the engaging-disengaging rolls 3. The operation device 8 carries out calculations on these signals, and the motor 9 is controlled on the basis of the results of the calculations, so that the dancer roll 2*a* of the first dancer means 2 is kept at the predetermined center position. Therefore, the first dancer means 2 can continuously control the tension on the magnetic tape web 1.

In the second section, the tension on the magnetic tape web 1 is controlled by the dancer roll 4*a*of the second dancer means 4, which dancer roll moves vertically. A position detector 11 detects the vertical position of the dancer roll 4*a* and generates a detection signal. The detection signal is fed to a comparator 12, which compares it with a predetermined position signal and generates a comparison signal which represents the results of the comparison. The comparison signal and a predetermined reference signal are fed to an operation device 13. The operation device 13 also receives a detection signal, which is generated by a detector 15 on the basis of the number of revolutions of a motor 14 which rotates the nip rolls 5. The operation device 13 carries out calculations on these signals, and the motor 14 is controlled on the basis of the results of the calculations, so that the dancer roll 4*a* of the second dancer means 4 is kept at the predetermined center position. Therefore, the second dancer means 4 can continuously control the tension on the magnetic tape web 1.

As described above, the tension on the magnetic tape web 1 is smoothly controlled when the engaging-disengaging rolls 3 are engaged with each other. However, when the engaging-disengaging rolls 3 disengage from each other, the magnetic tape web 1 is released from the holding force of the engaging-disengaging rolls 3. If no other means is provided to hold the magnetic tape web 1, the dancer roll 2*a* of the first dancer means 2 and the dancer roll 4*a* of the second dancer means 4 will move down sharply. In such cases, the speed at which the nip rolls 5 rotate will increase, and therefore the dancer roll 4*a* of the second dancer means 4 will be quickly returned to the predetermined center position However, in this condition, because the engaging-disengaging rolls 3 do not move the magnetic tape web 1, the dancer roll 2*a* of the first dancer means 2 cannot readily be moved up to the predetermined center position. In order to prevent such problems, this embodiment is provided with a lock mechanism 16 which holds the dancer roll 2*a* of the first dancer means 2 at the predetermined center position (or at the position in which the dancer roll 2*a* is located when the engaging-disengaging rolls 3 disengage from each other). The lock mechanism 16 is constituted of a pair of air cylinders 17*a* and 17*b*, which hold the dancer roll 2*a* from above and below. Air is introduced into and discharged from the air cylinders 17*a* and 17*b* through a solenoid valve 18. The lock mechanism 16 locks the position of the dancer roll 2*a* in synchronization with the disengagement of the engaging-disengaging rolls 3 from each other. Also, the lock mechanism 16 releases the dancer roll 2*a* from its locked position in synchronization with the engagement of the engaging-disengaging rolls 3 with each other. Specifically, an air cylinder 19 causes the engaging-disengaging rolls 3 to engage and disengage. Air is introduced into and discharged from the air cylinder 19 through a solenoid valve 20. Therefore, the solenoid valve 18 is opened and closed in synchronization with the opening and closing of the solenoid valve 20. For example, when an electric power switch 20*a* for the solenoid valve 20 is switched on, an electric power switch 18*a* for the solenoid valve 18 is simultaneously switched on. Also, when the electric power switch 20*a* is switched off, the electric power switch 18*a* is simultaneously switched off. In this manner, the position of the dancer roll 2*a* of the first dancer means 2 is locked and released in synchronization with the disengagement and engagement of the engaging-disengaging rolls 3.

Therefore, when the engaging-disengaging rolls 3 disengage from each other, the slack in the magnetic tape web 1 is taken up by the second dancer means 4 in the second section. At this time, the dancer roll 4*a* moves down sharply. However, as described above, the speed at which the nip rolls 5 rotate increases, and the dancer roll 4*a* is quickly moved up. Accordingly, the tension on the magnetic tape web 1 is continuously and accurately controlled.

In the aforesaid embodiment, a pair of air cylinders 17*a* and 17*b* are employed as the lock mechanism. However, any other type of lock mechanism may be employed insofar as the position of the dancer roll 2*a* of the first dancer means 2 is locked at a predetermined position, and this locked position is released in synchronization with the disengagement and engagement of the engaging-disengaging rolls 3.

The configuration of the apparatus wherein the method for controlling tension with a lock mechanism in accordance with the present invention is applied is not limited to the one described above. For example, a CPU may be employed in order to compare the signals and to carry out calculations by means of software.

We claim:

1. In a method for controlling tension on a tape web moving through a tape drive apparatus which includes a first dancer means, a pair of engaging-disengaging rolls which engage and disengage with each other, a second dancer means, and a pair of nip rolls located in this order from the upstream side to the downstream side in the direction along which said tape web moves, said tape drive apparatus operating so as to include the steps of engaging said engaging-disengaging rolls, adjusting the speed at which the engaging-disengaging rolls rotate on the basis of the vertical position of a dancer roll of the first dancer means, and adjusting the speed at which the nip rolls rotate on the basis of the vertical position of a dancer roll of the second dancer means to thereby adjust the tension on said tape web, wherein the improvement comprises the steps of:

(i) disengaging said engaging disengaging rolls while simultaneously locking the position of said dancer roll of said first dancer means at a predetermined position, and (ii) releasing said dancer roll of said first dancer means from the position in which said dancer roll is locked when said engaging-disengaging rolls engage each other.

2. A method as defined in claim 1, wherein the step of locking the position of said dancer roll of said first dancer means includes providing a lock mechanism which comprises a pair of air cylinders for holding said dancer roll of said first dancer means.

3. A method as defined in claim 1 wherein said tape web is a magnetic tape web.

4. An apparatus for controlling tension of a tape web comprising:

a locking means for locking and releasing;

a first dancer comprising a first dancer roll;

a pair of engaging-disengaging rolls;

a second dancer comprising a second dancer roll; and a pair of nip rolls, wherein said first dancer, said engaging-disengaging rolls, said second dancer, and said nip rolls are located in this order in a direction upstream to downstream of the movement of said tape web, and wherein the rotation speed of said engaging-disengaging rolls is adjusted according to the vertical position of said first dancer roll and rotation speed of said nip rolls is adjusted according to the vertical position of said second dancer roll, and wherein said locking means locks the position of said first dancer roll at a predetermined position when said engaging-disengaging rolls disengage from each other and said locking means releases said first dancer roll from said position when said engaging-disengaging rolls engage with each other.

* * * * *